US005088288A

United States Patent [19]

Katagishi et al.

[11] Patent Number: 5,088,288

[45] Date of Patent: Feb. 18, 1992

[54] REFRIGERATOR

[75] Inventors: Yoshihiro Katagishi; Takeshi Miyazawa; Hiroyuki Kiyota; Nobuo Fujii, all of Kamakura, Japan

[73] Assignee: Mitsubishi Denki Kabushiki Kaisha, Tokyo, Japan

[21] Appl. No.: 594,631

[22] Filed: Oct. 9, 1990

[30] Foreign Application Priority Data

Jan. 17, 1990 [JP] Japan ..... 2-7520

[51] Int. Cl.[5] ..... F25B 9/00

[52] U.S. Cl. ..... 62/6; 62/228.1

[58] Field of Search ..... 62/6, 228.1

[56] References Cited

U.S. PATENT DOCUMENTS

| | | | |
|---|---|---|---|
| 4,361,011 | 11/1982 | Callender et al. | 62/228.1 X |
| 4,397,155 | 8/1983 | Davey | 62/228.1 X |
| 4,543,793 | 10/1985 | Chellis et al. | 62/228.1 X |
| 4,694,228 | 9/1987 | Michaelis | 318/341 |
| 4,822,390 | 4/1989 | Kazumoto et al. | 62/6 |
| 4,872,313 | 10/1989 | Kazumoto et al. | 62/6 |

FOREIGN PATENT DOCUMENTS

| | | |
|---|---|---|
| 0343774 | 11/1989 | European Pat. Off. . |
| 2078863 | 1/1982 | United Kingdom . |

OTHER PUBLICATIONS

Proceedings of the Fourth International Cryocoolers Conference, Sep. 25-26, 1986, pp. 229-240, D. Marsden, "System Design Requirements for Infra-Red Detector Cryocoolers".

Proceedings of the Third Cryocooler Conference, Sep. 17-18, 1984, pp. 80-98, F. R. Stolfi et al., "Parametric Testing of a Linearly Driven Stirling Cryogenic Refrigerator".

*Primary Examiner*—William E. Wayner

*Attorney, Agent, or Firm*—Oblon, Spivak, McClelland, Maier & Neustadt

[57] ABSTRACT

A refrigerator comprises a compressor including a first cylinder having an inner cylindrical surface, a piston reciprocating in the first cylinder, and a linear motor for having a.c. electric input power applied thereto to drive the piston; a cold finger including a second cylinder having an elongated inner cylindrical surface, a displacer reciprocating in the second cylinder, and a cold space and a hot space which are divided by the displacer; a temperature detector for detecting the temperature in the cold space; an electric input power decision unit for having a detection signal inputted from the temperature detector and for deciding the electric input power to be applied to the linear motor so that the electric input power grows greater and greater as the temperature in the cold space decreases; and a power source for providing the electric input power to the linear motor based on the output from the electric input power decision unit.

10 Claims, 8 Drawing Sheets

REFRIGERATOR

The present invention relates to stirling cycle refrigerators which can cool e.g. an infrared sensor at temperatures as extremely low as e.g. 80 K.

FIG. 7 of the accompanying drawings shows the structure of a conventional stirling cycle refrigerator, which has been disclosed in Japanese Unexamined Patent Publication No. 10065/1989 which corresponds to U.S. Pat. No. 4822390.

In FIG. 7, the conventional stirling cycle refrigerator is mainly constituted by a compressor 1, cold finger 2 and a power source 38. The compressor 1 has a structure wherein a piston 3 which is positioned by a supporting spring 5 can reciprocate in a first cylinder 4. The supporting spring 5 has opposite ends coupled to members 20 and 21 which are fixed to the piston 3 and a housing 8, respectively.

To the piston 3 is coupled a lightweight sleeve 6 which is made of non magnetic material. On the sleeve 6 is wound an electric conductor to form a movable coil 7. The movable coil 7 has opposite ends connected to a first lead wire 9 and a second lead wire 10 which extend through the housing 8 to outside. These lead wires 9 and 10 have a first electric contact 11 and a second electric contact 12 for connection to the power source 38, the electric contacts being outside the housing 8. The housing 8 houses an annular permanent magnet 13 and a yoke 14 which constitute a closed magnetic field. The movable coil 7 is arranged so that it can reciprocate in the axial direction of the piston 3 in a gap 15 which is formed in the closed magnetic field. In the gap 15 is produced a permanent magnetic field in a radial direction transverse to the moving direction of the movable coil 7. The sleeve 6, the movable coil 7, the lead wires 9 and 10, the annular permanent magnet 13 and the yoke 14 constitute a linear motor 16 as a whole.

The inner space which is formed above the piston 3 in the first cylinder 4 is called a compression space 17. The compression space 17 has a high pressure gas such as helium gas sealed in it. In the gap between the first cylinder 4 and the piston 3 are arranged seals 18 and 19 to prevent the working gas in the compression space 17 from leaking through the gap. The compressor 1 is constituted in this manner.

On the other hand, the cold finger 2 includes a second circular cylinder 35, and a displacer 23 which can reciprocate so as to be slidable in the second cylinder 35 and which is supported a resonant spring 22 in the second cylinder 35. The internal space of the second cylinder 35 is divided into two parts by the displacer 23. The upper space above the displacer 23 is called a cold space 24, and the lower space under the displacer is called a hot space 25. In the displacer 23 are arranged a regenerator 26 and gas passage holes 27 and 28. The cold space 24 and the hot space 25 are interconnected through the regenerator 26 and the gas passages holes 27 and 28. The regenerator 26 is filled with a regenerator matrix 29 such as a plurality of copper wire mesh screens. In the gap between the displacer 23 and the second cylinder 35 are arranged seals 30 and 31 to prevent the working gas from leaking through the gap. The chambers 24, 25 and 26 of the cold finger 2 have a working gas such as helium gas sealed in them under a high pressure like the compressor 1. The cold finger 2 is constructed in this manner. The compression space 17 of the compressor 1 and the hot space 25 of the cold finger 2 are interconnected through a cooler 32 which is arranged at the top of the first cylinder 4. The compression space 17, the hot space 25, the regenerator 26 and the cold space 24 are connected in series. They are called a working space 33 as a whole.

An a.c. current which has a constant frequency in the form of a sinusoid, e.g. 50 Hz, is supplied to the movable coil 7 of the linear motor 16 by the a.c. power supply 38 which has a definite output.

The operation of the conventional refrigerator as constructed above will be described.

When the power supply 38 provides the a.c. current to the movable coil 7 through the electric contacts 11 and 12, and the lead wires 9 and 10, the movable contact 7 is subjected to a Lorentz force in the axial direction due to the interaction of the permanent magnetic field in the gap 15 and the current flowing through the coil. As a result, the assembly constituted by the piston 3, the sleeve 6 and the movable coil 7 moves vertically in the axial direction of the piston 3.

When such a sinusoidal current is applied to the movable coil 7, the piston 3 reciprocates in the cylinder 4, giving sinusoidal undulation to the gas pressure in the working space 33 of the compression space 17 through the cold space 24. The sinusoidal pressure undulation causes the flow rate of the gas passing through the regenerator 26 in the displacer 23 to periodically change, so the pressure loss in the regenerator 26 produces a periodical pressure difference across the displacer 23. The resonance between the pressure difference and the resonant spring 22 causes the displacer 23 including the regenerator 26 to reciprocate in the cold finger 2 in the axial direction at the same frequency as the piston 3 and out of phase with the piston 3.

When the piston 3 and the displacer 23 are moving keeping a suitable difference in phase, the working gas sealed in the working space performs a thermodynamic cycle known as the "Inverse Stirling Cycle", and generates cold production mainly in the cold space 24. The "Inverse Stirling Cycle" and the principle of generation of the cold production thereby are described in detail in "Cryocoolers", (G. Walker, Plenum Press, New York, 1983, pp. 117-123). The principle will be described briefly.

The working gas in the compression space 17 which has been compressed by the piston 3 and heated thereby is cooled while flowing through the cooler 32, and the cooled gas flows into the hot space 25, the gas passage hole 27 and the regenerator 26. The working gas is precooled in the regenerator 26 by the cold production which has been accumulated in a preceding half cycle, and enters the cold space 24. When most of the working gas has entered the cold space 24, expansion starts, and cold production is generated in the cold space 24. After that, the working gas returns through the same route in the reverse order, releasing the cold production to the regenerator 26, and enters the compression space 17. At the time, heat is removed from the leading portion of the cold finger 2, causing the surroundings outside the leading portion to be cooled. When most of the working gas has returned to the compression space 17, compression restarts, and the next cycle commences. The process as described above is repeated to gradually decrease the temperature in the cold space 24, reaching a extremely low temperature (e g. about 80 K).

The conventional cryogenic refrigerator involves the problem as described below. When a definite a.c. current is supplied to the movable coil 7 to reciprocate (vibrate) the piston 3, the amplitude of the piston 3 changes depending on the temperature in the cold space 24 of the cold finger 2. The amplitude of the piston has a tendency to decrease as the temperature in the cold space grows lower, which is shown in FIG. 8. This is because the phase difference $\alpha$ between the piston and the pressure wave shown in FIG. 9 grows larger to increase compression resistance as the temperature in the cold space decreases, thereby to lessen the amplitude of the piston.

For these reasons, when the cold space 24 of the cold finger 2 is cooled from room temperature of 300 K to a cryogenic temperature of 80 K, the amplitude of the piston grows smaller and smaller. As a result, the pressure amplitude of the operating gas decreases to lower cooling speed, thereby creating a problem wherein cool down time (the time required for cooling from room temperature to a cryogenic temperature) is lengthened.

It is an object of the present invention to dissolve the problem, and to provide a refrigerator capable of shortening the cool down time.

The foregoing and other objects of the present invention have been attained by providing a refrigerator comprising: a compressor including a first cylinder having an inner cylindrical surface, a piston reciprocating in the first cylinder, and a linear motor for having a.c. electric input power applied thereto to drive the piston; a cold finger including a second cylinder having an elongated inner cylindrical surface, a displacer reciprocating in the second cylinder, and a cold space and a hot space which are divided by the displacer; a temperature detector for detecting the temperature in the cold space; an electric input power decision unit for having a decision signal inputted from the temperature detector and for deciding the electric input power to be applied to the linear motor so that the electric input power grows greater and greater as the temperature in the cold space decreases; and a power source for providing the electric input power to the linear motor faced on the output from the electric input power decision unit.

In accordance with the present invention, the amplitude of the piston can be prevented from lessening even if the temperature in the cold space decreases, thereby shortening the cool down time.

Figure 1:
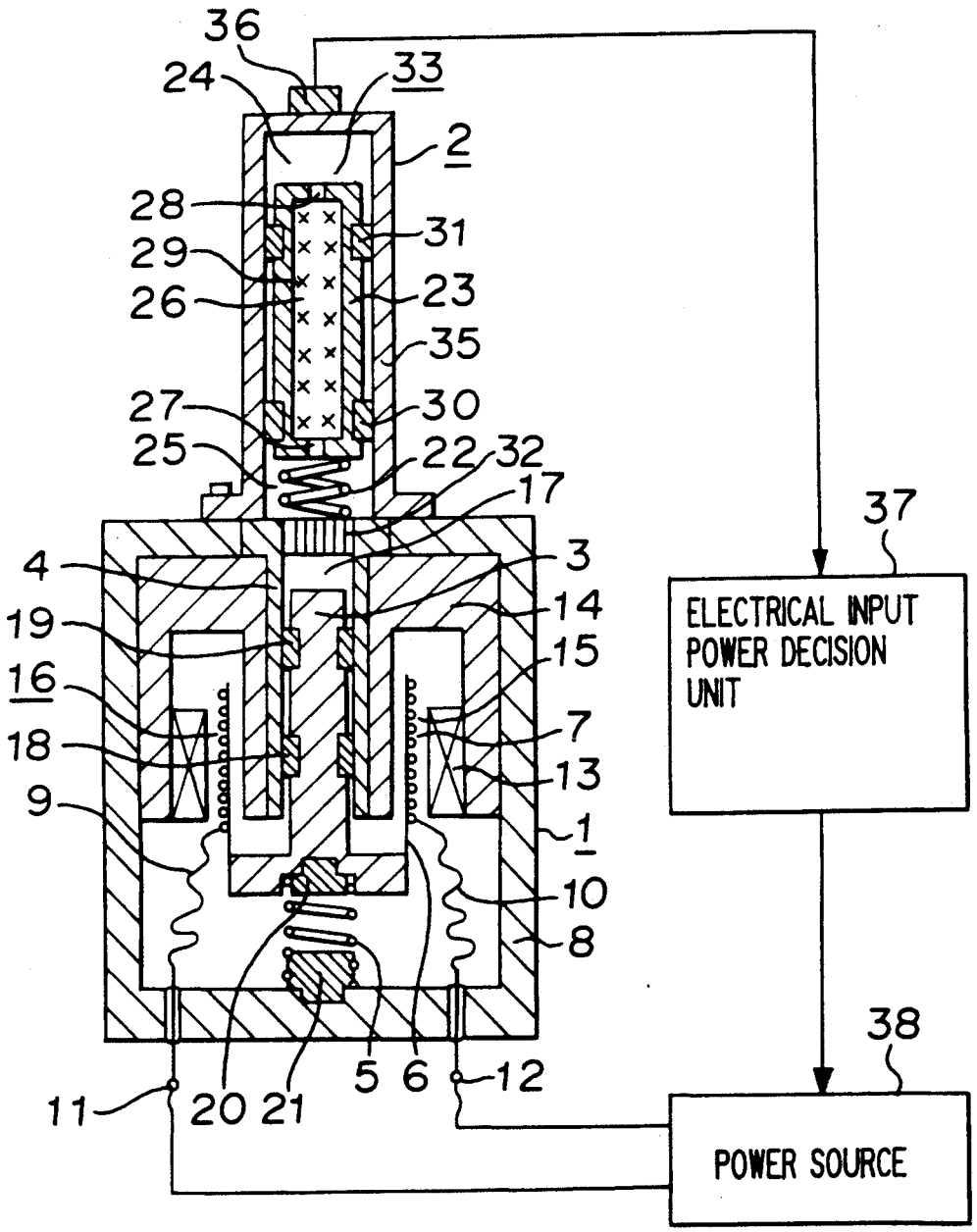
FIG. 1 is an axial sectional view of an embodiment of the refrigerator according to the present invention.
Figure 7:
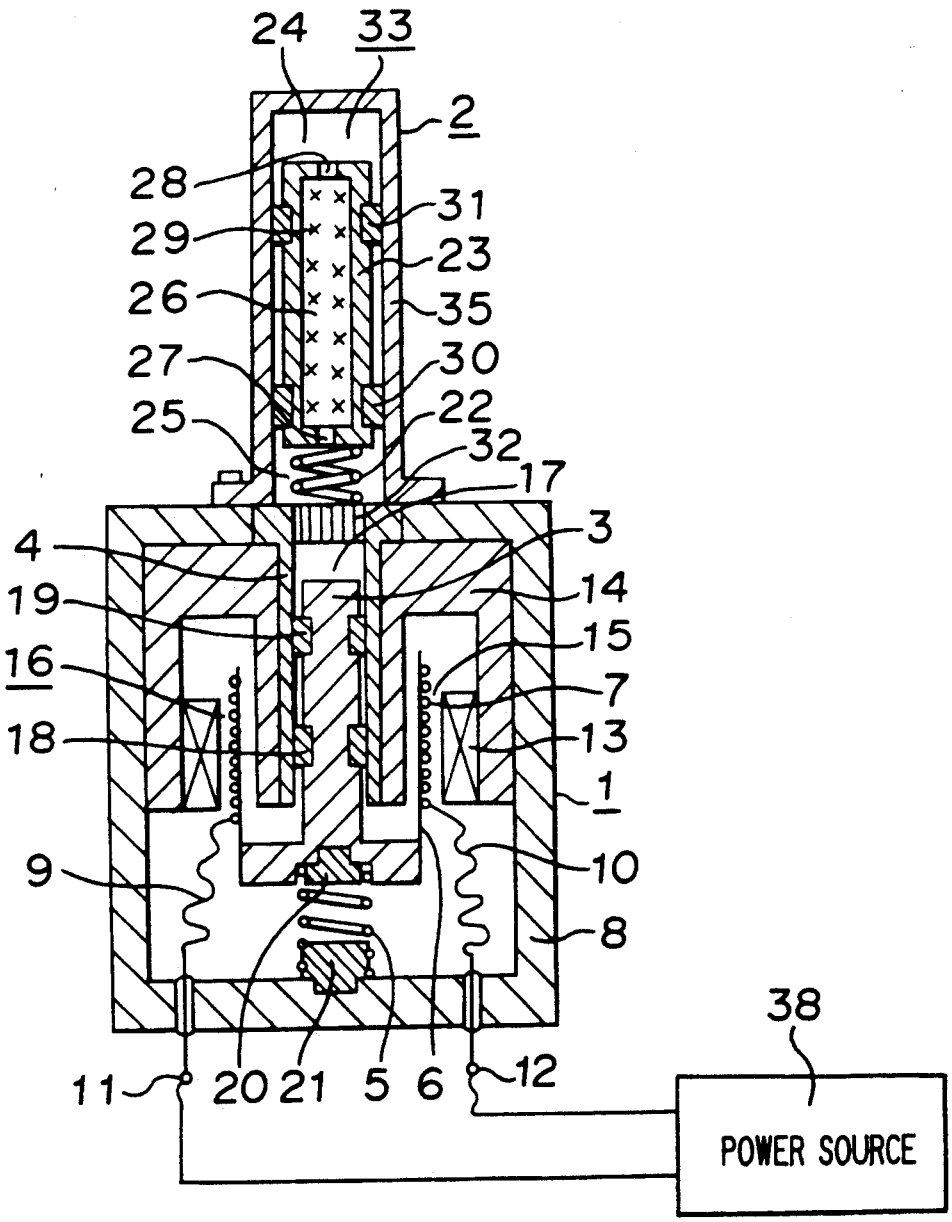
FIGURE 7 PRIOR ART
FIG. 7 is an axial cross-sectional view showing the conventional refrigerator.
Figure 8:
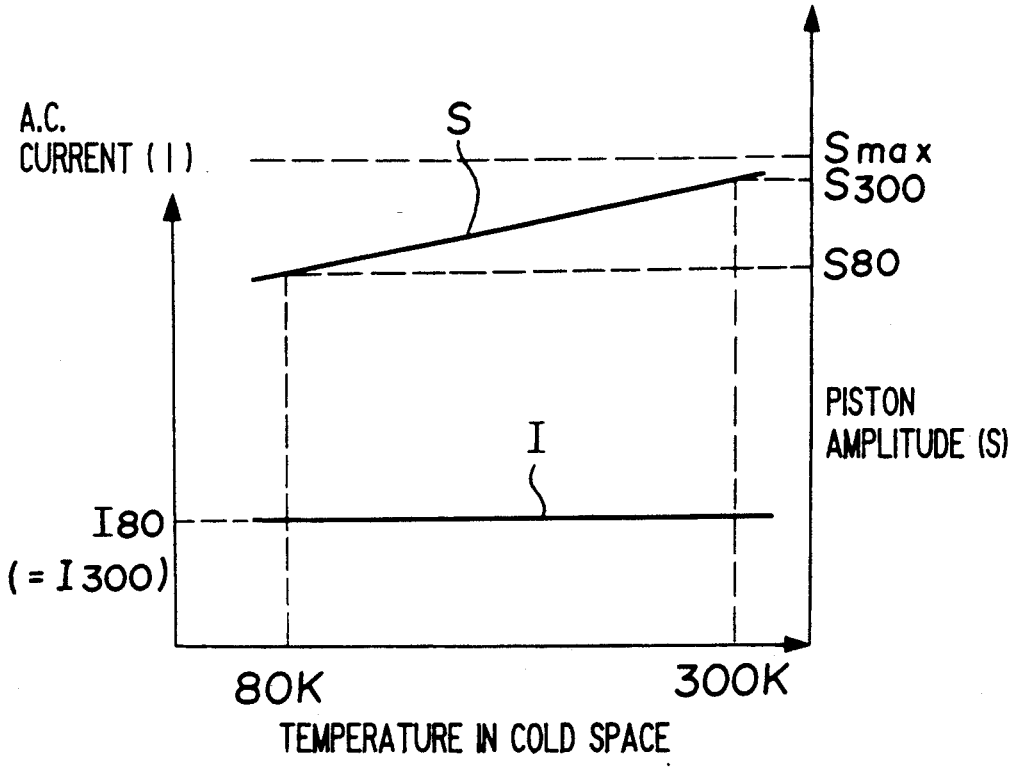
FIGURE 8 PRIOR ART
FIG. 8 is a graphical representation showing the relationship among the temperature in the cold space, the a.c. current and the piston amplitude in the conventional refrigerator.
Figure 9:
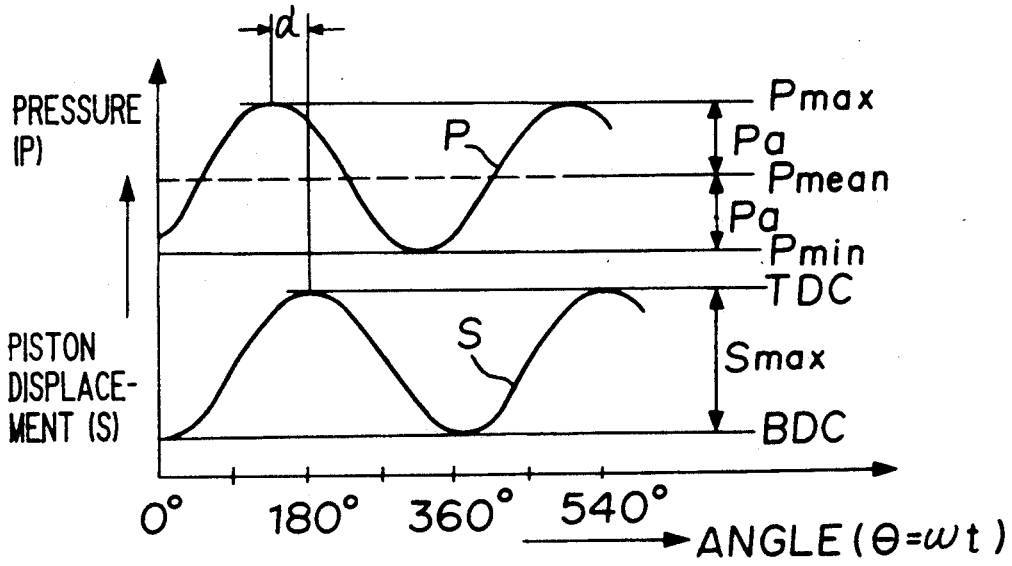
FIGURE 9 PRIOR ART
FIG. 9 is a timing chart showing the relationship between the piston movement and the pressure variation of the working gas in the compression space in the conventional refrigerator.

Now, the present invention will be described in further detail with reference to preferred embodiments illustrated in the accompanying drawings. In FIG. 1, the basic structures of the compressor indicated by reference numeral 1 and the cold finger indicated by reference numeral 2 according to the present invention are similar to the conventional refrigerator which has been discussed in the introduction part of the specification. Parts which correspond and are similar to those of the conventional refrigerator are indicated by the same reference numeral as the conventional refrigerator in FIG. 7, and explanation on the parts indicated by these reference numerals will be omitted for the sake of clarity. Reference numeral 36 designates a temperature detector which is attached to the outer surface of the top of the cold space 24 of the cold finger 2 to detect the temperature in the cold space 24. Reference numeral 37 designates an electrical input power decision unit which receives a detection signal from the temperature detector 36 and decides electric input power to be applied to the linear motor 16. Reference numeral 38 designates a power source which provides the linear motor 16 of the compressor 1 with electrical input power based on the output from the electrical input power decision unit 37.

By this arrangement, the temperature in the cold space 24 of the cold finger 2 is detected by the temperature detector 36. The electric input power decision unit 37 receives the detection signal from the temperature detector 36, and decides electrical current power to be applied to the movable coil 7 of the linear motor 16. The power source 38 adjusts the electrical current power based on the decision of the electric input power decision unit 37 to control the amplitude of the piston 3.

Figure 2:
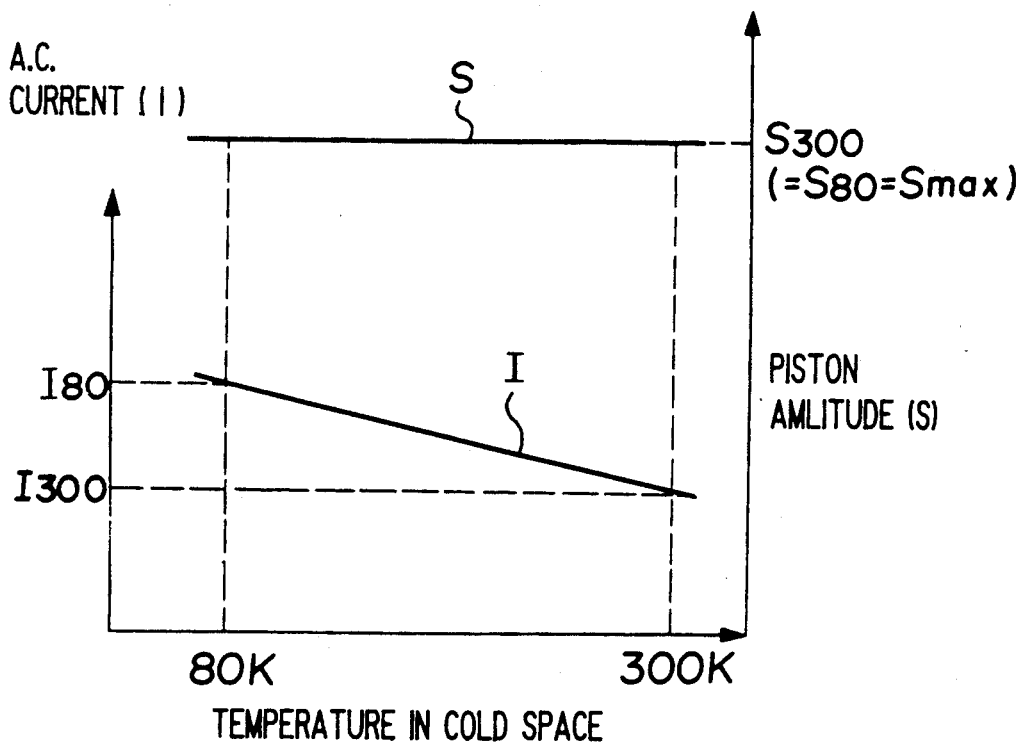
FIG. 2 is a graphical representation showing the relationship among the temperature in a cold space, an a.c. current and a piston amplitude in the embodiment.

FIG. 2 shows a graphical representation showing the relationship among the temperature in the cold space 24, the applied a.c. current and the amplitude of the piston 3. As the temperature in the cold space 24 decreases, the a.c. current power is linearly increased to keep the amplitude of the piston 3 at the maximum. This can prevent the pressure amplitude of the working gas from reducing, thereby allowing the cooling speed to be maintained at the same level and the cool down time to be shortened.

FIG. 2 shows the embodiment wherein the current power to be applied to the movable coil 7 is controlled. The present invention is also practiced even if voltage power to be applied to the movable coil is controlled.

Figure 3:
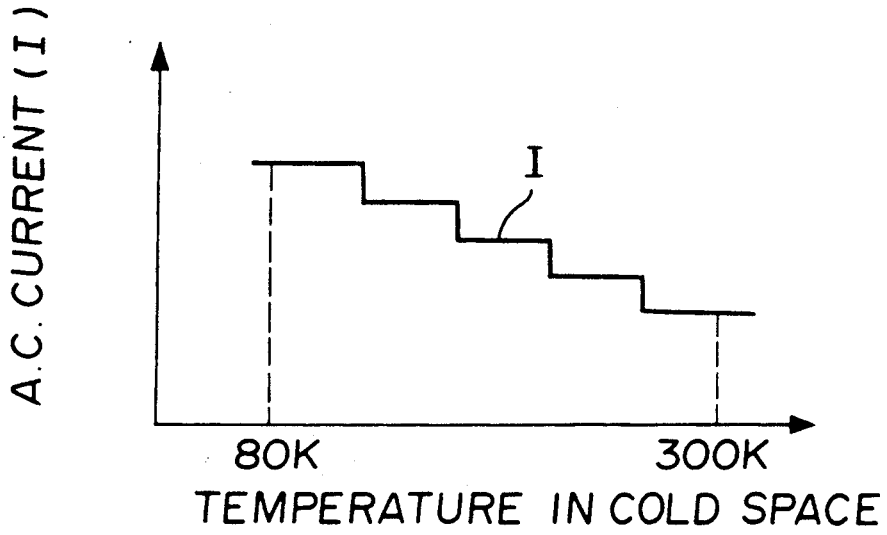
FIGS. 3 and 4 are a graphical representation showing the relationship between the temperature in a cold space and an a.c. current in other embodiments, respectively.
Figure 4:
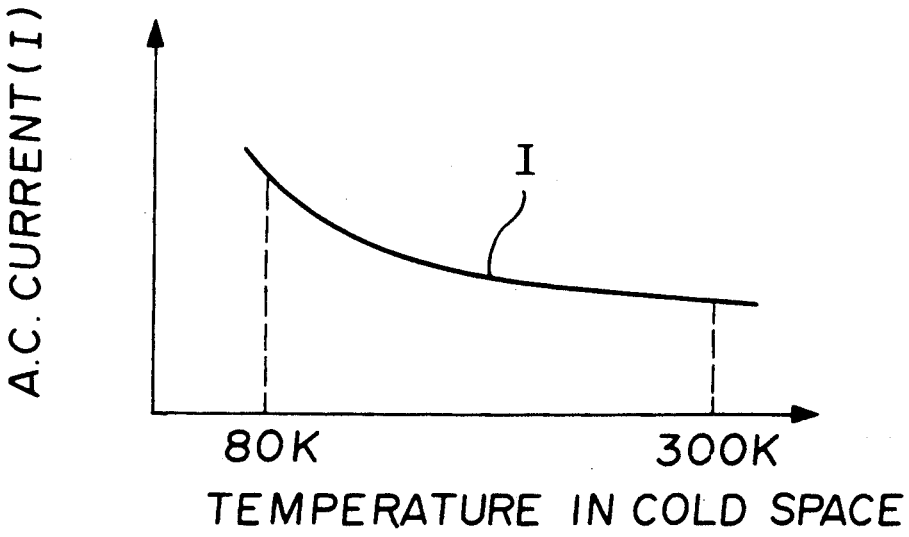

Although in the embodiment of FIG. 2 the current power from the power source 38 is linearly changed with respect to the temperature in the cold space 24, the current power can be changed in a stair-stepped or curved manner as shown in FIGS. 3 and 4.

Figure 5:
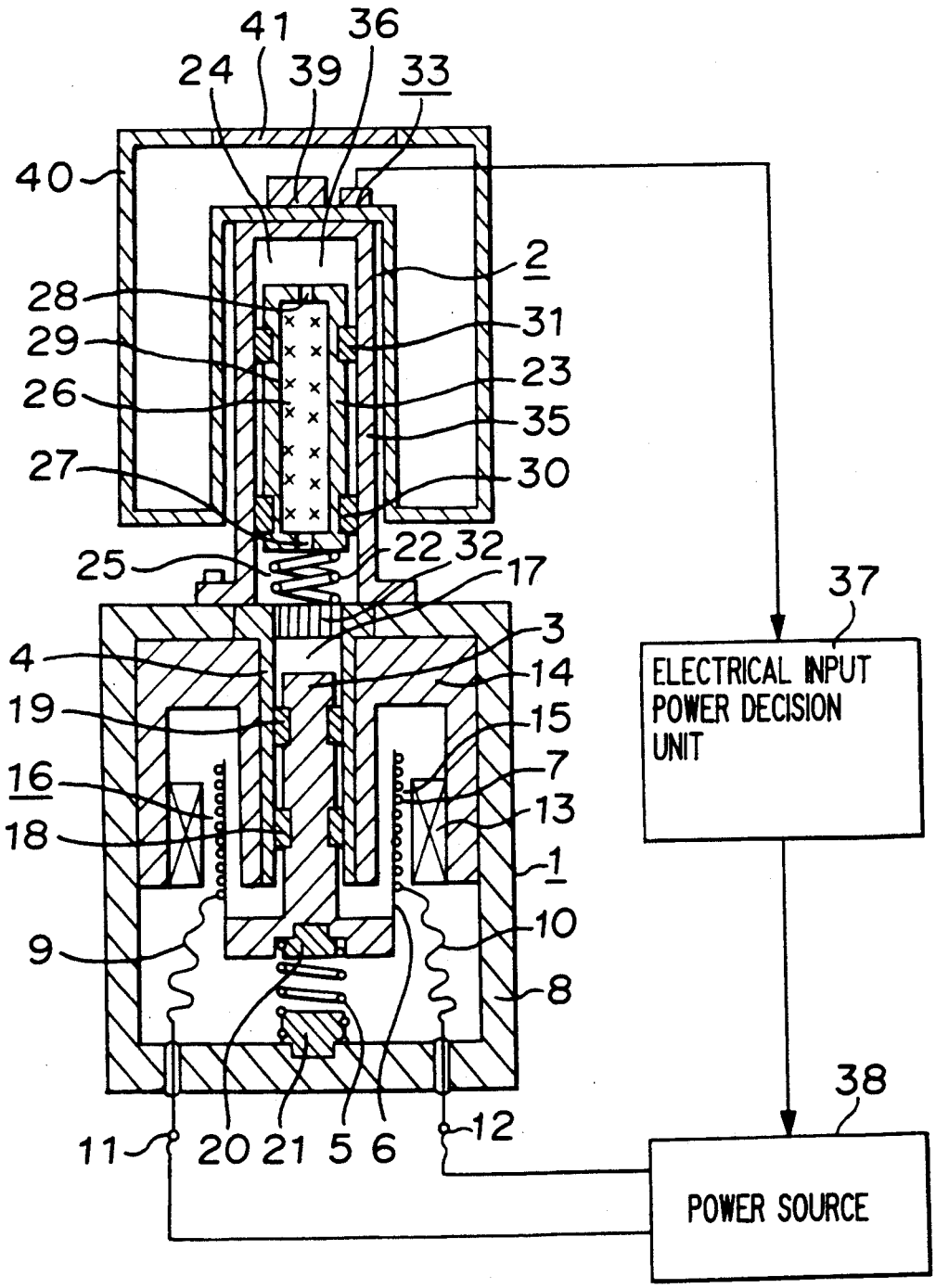
FIGS. 5 and 6 are an axial cross-sectional view showing other embodiments of the refrigerator according to the present invention, respectively.

Although in the embodiment of FIG. 1 the temperature detector 36 is provided on the top of the cold finger 2, the location of the temperature detector is not limited to this location. When the refrigerator according to the present invention is used to cool an infrared sensing element 39 as shown in FIG. 5, an infrared detector 40 including the infrared sensing element 39 can be mounted on the cold finger 2, and the temperature detector 36 can be arranged in the infrared detector 40. The infrared detector 40 is a thermally insulated and evacuated vessel which has an element for detecting infrared rays arranged in it, and which can accept infrared rays through a window 41 formed in a part of the vessel wall to detect the infrared rays by the infrared sensing element 39. The infrared sensing element 39 is arranged on the inner surface of the portion of the vessel wall which is in touch with the cold finger 2 because the infrared sensing element 39 can not work in a proper manner without being cooled to an extremely low temperature. The temperature detector 36 can be incorporated into the infrared sensing element 39.

In the embodiment of FIG. 5, the presence of thermal resistance between the temperature detector 36 and the cold space 24 causes an error to make the temperature detected by the temperature detector 36 and the actual temperature in the cold space 24 differentiate because the temperature detector 36 detects the temperature in the cold space 24 indirectly through the walls of the vessel and the cold finger. However, such extent of error is no obstacle to the practice of the present invention.

Figure 6:
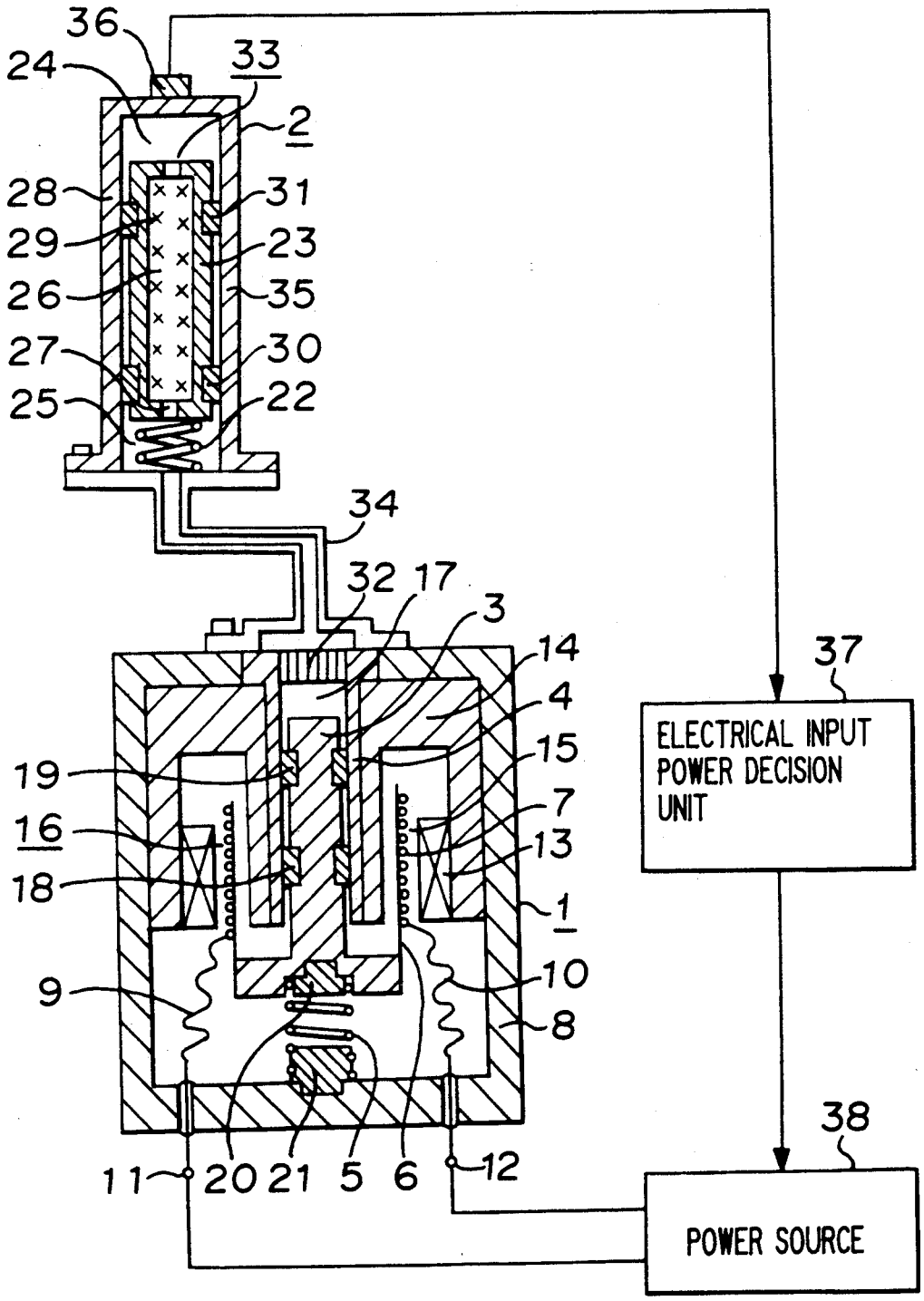

Although the explanation on the embodiments has been made for the stirling cycle refrigerator wherein the compressor 1 and the cold FIG. 2 are composed as one unit, similar effect can be obtained whatever structure stirling cycle refrigerators including the linear motor 16 have, like e.g. a separate type of stirling cycle refrigerator wherein the compressor 1 and the cold finger 2 are separated and are connected through a connecting pipe 34 as shown in FIG. 6.

What is claimed is:

1. A refrigerator comprising:

a compressor including a first cylinder having an inner cylindrical surface, a piston reciprocating in the first cylinder, and a linear motor for having a.c. electric input power applied thereto to drive the piston;

a cold finger including a second cylinder having an elongated inner cylindrical surface, a displacer reciprocating in the second cylinder, and a cold space and a hot space which are divided by the displacer;

a temperature detector for detecting the temperature in the cold space;

an electric input power decision unit for having a detection signal inputted from the temperature detector and for deciding the electric input power to be applied to the linear motor so that the electric input power grows greater and greater as the temperature in the cold space decreases; and a power source for providing the electric input power to the linear motor based on the output from the electric input power decision unit.

2. A refrigerator according to claim 1, wherein the temperature detector is mounted on the outer surface of the top of the cold space.

3. A refrigerator according to claim 1, wherein the electric input power is linearly increased as the temperature in the cold space decreases.

4. A refrigerator according to claim 1, wherein the electric input power is increased in a stair-stepped manner as the temperature in the cold space decreases.

5. A refrigerator according to claim 1, wherein the electric input power is increased in a curved manner as the temperature in the cold space decreases.

6. A refrigerator according to claim 1, wherein the electric input power decision unit controls an a.c. current to be applied to the linear motor.

7. A refrigerator according to claim 1, wherein the electric input power decision unit controls an a.c. voltage to be applied to the linear motor.

8. A refrigerator according to claim 1, wherein the refrigerator is used to cool an infrared sensing element, and wherein the temperature detector is arranged in a infrared detector including the infrared sensing element.

9. A refrigerator according to claim 8, wherein the infrared sensing element is located at a position closest to the cold finger.

10. A refrigerator according to claim 1, wherein the compressor and the cold finger are separated and connected through a connecting pipe.

* * * * *